United States Patent [19]

Stille

[11] 4,152,840

[45] May 8, 1979

[54] GRAIN DRYER CONTROL SYSTEM

[75] Inventor: Larry L. Stille, Rockford, Iowa

[73] Assignee: David Manufacturing Co., Mason City, Iowa

[21] Appl. No.: 829,514

[22] Filed: Aug. 31, 1977

[51] Int. Cl.[2] ..... F26B 17/20

[52] U.S. Cl. ..... 34/56; 414/213

[58] Field of Search ..... 214/17 A, 17 B, 17 CA, 214/17 DA; 34/56, 52, 225, 233; 236/99; 73/349, 351

[56] References Cited

U.S. PATENT DOCUMENTS

| | | | |
|---|---|---|---|
| 2,858,620 | 11/1958 | Naylor | 34/56 |
| 3,714,718 | 2/1973 | Sukup | 34/56 |
| 3,946,496 | 3/1976 | Sukup | 34/56 |

*Primary Examiner*—John J. Camby
*Assistant Examiner*—Larry I. Schwartz
*Attorney, Agent, or Firm*—Merchant, Gould, Smith, Edell, Welter & Schmidt

[57] ABSTRACT

A control system for a grain drying bin includes a pre-dry sensor mounted on the inside of a grain drying bin a short distance above the floor and a thermocouple grain temperature sensor mounted in the discharge tube of the grain drying bin. The discharge grain temperature sensor includes a thermal contact member made of copper or other heat conductive material having a thermocouple bonded thereto to intimate heat conducting relationship. The thermal contact member is mounted by a mounting block to the discharge tube to extend through a slot into the interior of the tube and is shaped to allow the grain to flow around it in thermal contact therewith. A gap is provided in the fighting of the discharge auger in order to provide clearance for the thermal contact member. The control system prevents discharge of grain until the pre-dry temperature is attained, and controls stopping of the grain discharge, in either a sample mode or a discharge mode, if the discharged grain is too cool.

17 Claims, 9 Drawing Figures

GRAIN DRYER CONTROL SYSTEM

BACKGROUND OF THE INVENTION

The present invention pertains generally to the field of controls for gain drying bins. Grain drying bins are widely used in the farming industry to reduce the moisture content of grain to acceptable levels prior to storage or marketing. Often the grain is initially run through a drying bin, and as the grain is dried, it is then transferred by augers to storage bins.

A typical drying bin forces warm dry air through a suitably apertured floor. The air then circulates around the grain particles, working its way up through the grain in the bin. In so doing, the air warms the grain and absorbs some of its moisture, and in turn the air is cooled and becomes moisture laden. In this manner, drying proceeds upwardly in zones through the drying bin. Periodically, as the grain is being dried, the warmest and driest layers from the bottom of the drying bin are drawn off, usually by means of sweep augers, and a discharge auger. A transfer auger transfer grain from the discharge auger to a storage bin.

Because the drying process can proceed at different rates, depending upon the moisture content of the grain, the type of grain, ambient air temperature and humidity and the intensity of the applied heat, it is necessary to provide some type of control system. Generally, it is convenient to allow the air heating and circulating equipment to operate according to its optimum design characteristics, and to control the overall drying by controlling the removal rate for the dried grain from the bottom of the bin. This in turn is done by controlling the sweep and discharge augers periodically according to a preset timer, intermittently according to sensed grain moisture, or by a combination of both.

The prior art has used many types of sensing systems for sensing, humidity or temperature of the grain or air at a selected zone. One type of system uses a sensing element placed at a point around the periphery of the drying bin at a preselected elevation above the floor. However, this type of system has certain inherent disadvantages because its operation depends on the assumption that uniform drying occurs at equal elevations above the floor. However, in practice there may be wet spots or zones which may be missed by this type of sensor. Other types of sensors are mounted at the discharge auger from the bin, for sampling the moisture content or temperature of the grain being discharged. In this type of system, the motor for the sweep and discharge augers is started periodically by a timer, then remains in motion until the temperature or wetness of the grain can be sampled at the discharge. If the grain is wet, the discharge mechanism is stopped to await another predetermined time interval while the grain drying apparatus continues in operation.

One difficulty that has been encountered with the type of system described above relates to the discharge of excessive amounts of wet grain in the process of discharging a large number of samples before the grain is fully dried. In a sample period at the end of a drying interval, the sweep and discharge augers must remain in operation for a sufficient interval of time, typically several minutes, to allow an accurate sample of grain from the bin to reach the moisture sensor location in the discharge tube, before a decision can be made as to stopping the augers for another drying interval, or keeping them going for unloading and transfer. During the initial stages of drying of a quantity of grain, a number of dry and sample cycles may be run through before the grain is ready for transfer, and the total amount of wet grain removed in the sample periods can present a problem.

Various types of moisture or temperature sensors have been used for sensing the condition of the grain at the discharge tube of a grain drying apparatus. One aspect of the present invention pertains to an improvement in a discharge grain temperature sensor. This sensor measures the temperature of the grain rather than measuring the moisture directly; however, since there is a direct correlation between moisture content and temperature of the grain exiting from the drying bin, the sensor can provide a convenient and useful measure of the grain moisture content.

When using a small sensing element such as a thermocouple, the dimensions of the sensing element are small compared with the dimensions of the discharge tube and the grain kernels. For this reason the contact between the grain and the thermocoupled on the inside wall of the discharge tube is relatively poor. This has the effect of decreasing the sensitivity and responsiveness of the control system to stop the discharge of grain when a zone of insufficiently dried grain has been reached.

SUMMARY OF THE INVENTION

In order to overcome these and other problems, the present invention provides an improved control system for a grain dryer. In addition to a grain temperature sensor mounted in the discharge auger tube, a pre-dry temperature sensor is mounted within the bin a short distance above the floor. The control system delays the sample and discharge modes of operation during a pre-dry mode until a preselected temperature of the grain is achieved, thus avoiding unnecessary sampling and unwanted discharge of wet grain. In the sample and dry mode the system samples the temperature of the grain reaching the discharge tube at predetermined intervals, then pauses or continues the discharge of grain depending upon the temperature of the grain in the sample. When cold grain is detected at the discharge tube, the sweep and discharge augers are stopped and the system returns to the sample and dry mode or the pre-dry mode depending upon the temperature of the grain detected by the pre-dry sensor.

The present invention also provides an improved moisture sensor for the discharge tube of a grain drying bin. The improved moisture sensor comprises a thermocouple, a thermal contact member, means for positioning the thermocouple in thermal contact with the member, and means for positioning the member projecting into the interior of the grain discharge path.

According to a preferred embodiment of the invention, the thermal contact member may be a vane which is positioned by a mounting block which is bolted or otherwise secured to the outside of the grain discharge tube, near its exit from the grain bin. A slot is provided in the discharge auger tube, and the vane projects through the slot into the interior of the discharge tube, in axial alignment with the flow of grain in the tube. A gap or connecting sleeve is provided for the discharge auger, so as to provide a gap in the flighting of the auger in order to provide a clearance for the vane.

DESCRIPTION OF THE PREFERRED EMBODIMENT

Figure 1:
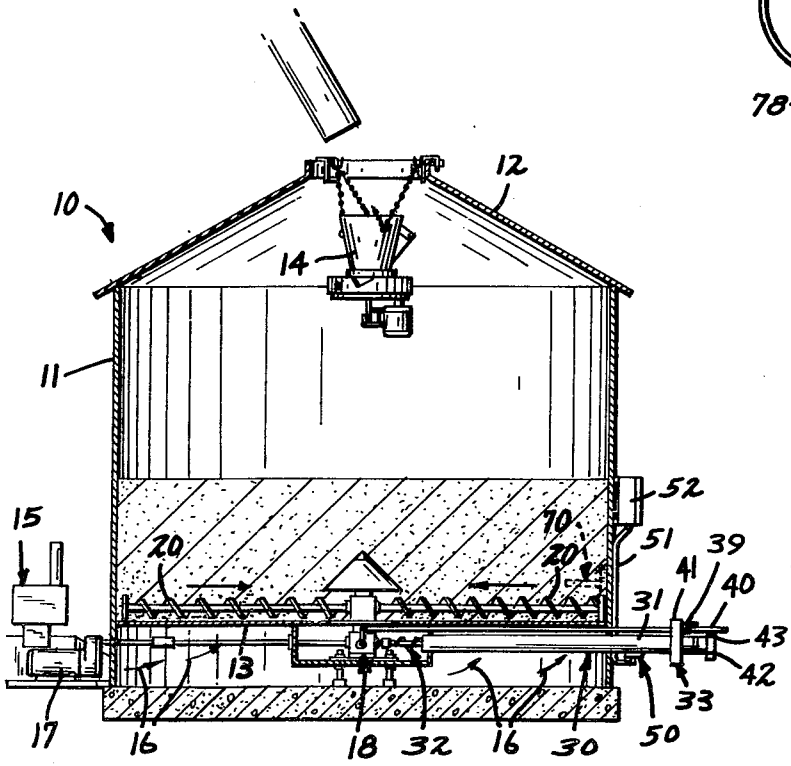
FIG. 1 is a vertical section of a drying bin generally of the type with which the present invention is used.

In FIG. 1, reference number 10 generally designates a grain drying bin, of the general type to which the present invention may be advantageously applied. Bin 10 comprises a cylindrical wall 11, a conical roof 12, and a floor 13 having a plurality of air flow apertures therein. A distributor assembly may be provided as at 14 for loading grain to be dried into the bin.

Reference number 15 generally designates a drier assembly which provides a circulation of heated air as indicated by arrows 16, to the underside of floor 13. The heated air then circulates up through the floor and around the grain kennels towards the top of the bin. The driest and warmest zone of the grain is thus the bottom layer within the bin.

A plurality of sweep augers 20 may be provided. A motor 17 driving through a suitable power transmission generally indicated by reference number 18 provides the motive force to operate the sweep augers, while rotating them around the floor area of the bin. In this manner, the lower layer of the dried grain is swept inwardly to the center, where it drops down to the discharge auger. In FIG. 1, reference number 30 generally designates the discharge auger assembly. This assembly includes a discharge tube 31 and the discharge auger 32. The discharge auger assembly extends from the center of the bin beneath the floor, where the sweep augers deliver the dried grain, to the outside wall of the bin to a discharge end generally designated in FIG. 1 by reference number 33, and shown in greater detail in FIG. 2. Also shown in FIG. 1 is sensor assembly 50 mounted beneath discharge tube 31, on the outside of the bin, near the discharge end of the discharge tube assembly.

Figure 2:
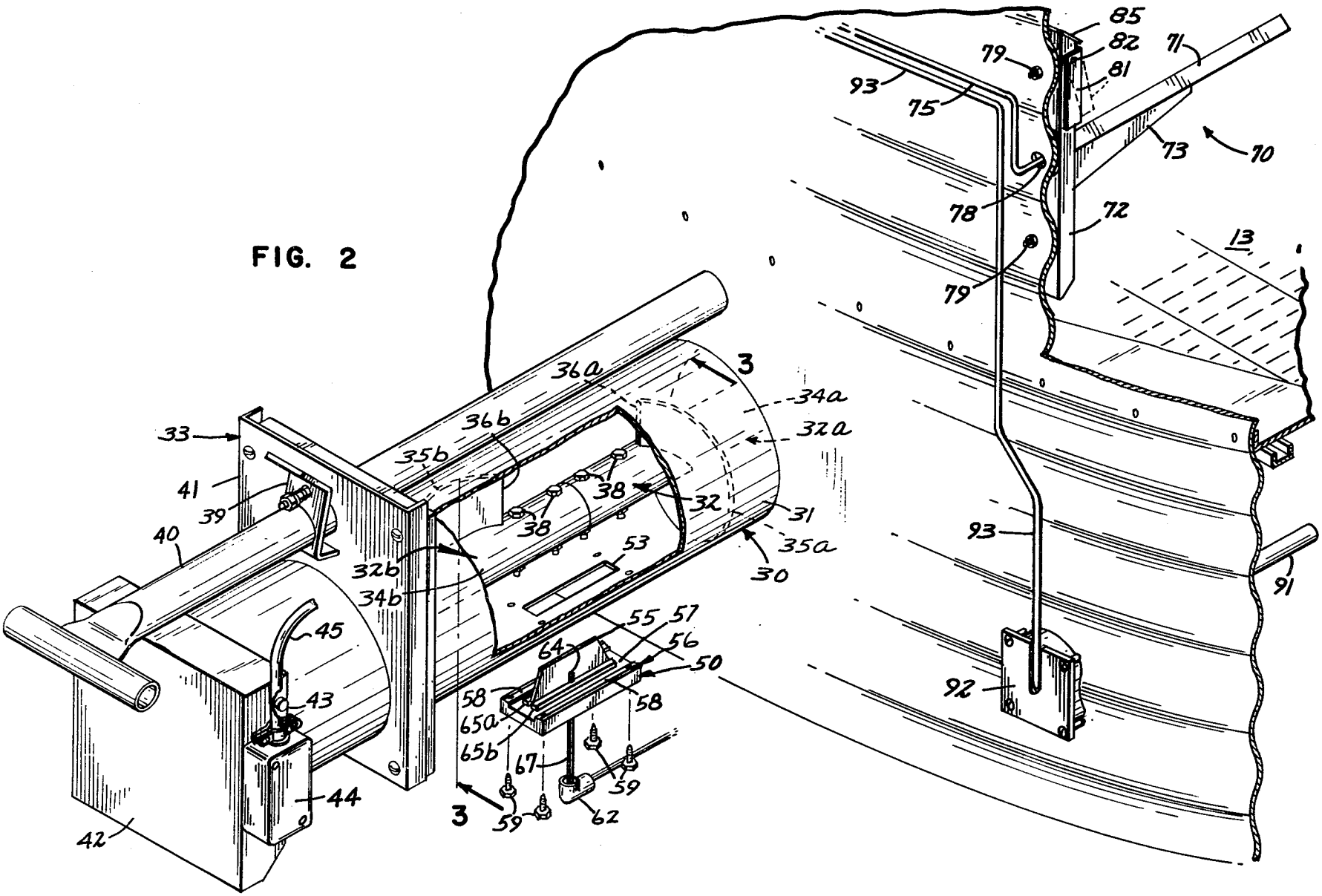
FIG. 2 is an enlarged exploded perspective of a portion of a drying bin and a discharge auger showing the mounting of the temperature sensors of the present invention.

Referring to FIG. 2, the discharge end 33 of the discharge tube assembly is shown in greater detail. Discharge auger tube 31 extends outwardly through a clearance hole provided for that purpose from the wall 11 of the bin. A portion of discharge auger tube 31 is broken away in FIG. 2 for showing components inside.

A control rod 40 also extends through bin wall 11, parallel to and slightly above discharge auger tube 31. Control rod 40 extends to a slide gate in the floor near the center of the bin for controlling delivery of the grain as is generally known. A mounting plate 41 is positioned on discharge auger tube 31 near its outer end, and has an aperture through which control rod 40 passes. A locking mechanism 39 may be provided as is generally known for locking control rod 40. A cover 42 may be provided at the end of discharge tube 31. Cover 42 may be hinged as at hinge 43, to allow the cover to open when grain is being discharged.

An auger overload switch assembly 44 is mounted to the flanged side of cover 42. A cable 45 connects from switch 44 to rest of the control system. Switch 44 is a mercury switch which responds to the angular position of cover 42. As grain is being discharged, cover 42 swings outwardly at an angle up to approximately 45 degrees in normal operation. In case the transfer auger (not shown) to which grain is being delivered by the discharge auger should become overloaded or stopped for some reason, grain will tend to spill out and pile up on the ground. When this happens cover 42 will be tilted out to a horizontal position, which will open overload switch 44 and stop the discharge as explained more fully hereinafter.

Figure 3:
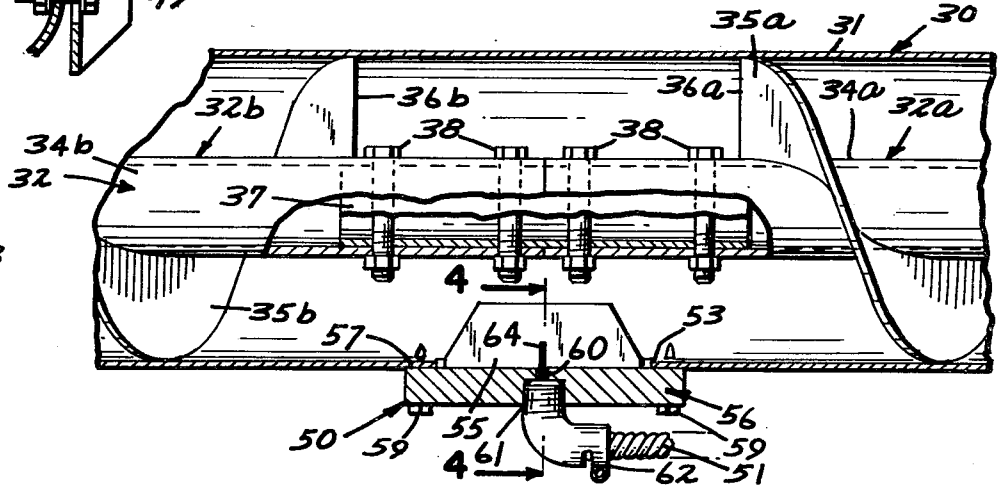
FIG. 3 is a longitudinal section generally along line 3—3 of FIG. 2.

As seen in FIGS. 2 and 3, a slot 53 is provided in the wall of discharge auger tube 31, with the long dimension of the slot being aligned with the axis of the tube. Sensor assembly 50 is mounted as explained hereinafter so that the thermal contact member 55 extends through a slot 53 into the interior of discharge auger tube 31. A gap is provided in the flighting of the discharge auger in order to provide a clearance for the sensor vane. This can be done either by removing a portion of flighting from the discharge auger, or as is done in the preferred embodiment, by providing two separate sections of the discharge auger 32.

As seen in FIGS. 2 and 3, discharge auger 32 has an inner section **32*a* and an outer section 32*b*. Inner section 32*a* comprises an auger shaft 34*a*, and auger flighting 35*a* which is secured to shaft 34*a*, but which ends at 36*a* a distance before the end of auger shaft 34*a*. Similarly, outer section 32*b* of the discharge auger comprises an auger shaft section 34*b*, to which is secured the flighting 35*b*. The flighting ends at 36*b* a distance from the end of shaft 34*b***.

The ends of auger shaft sections **34*a* and 34*b* are butted together, and a connecting sleeve 37 having an outside diameter slightly less than the inside diameter of the auger shaft sections is inserted therein. Connecting bolt and nut assemblies 38 are secured through holes provided in the ends of the auger shaft sections and the connecting sleeve, to secure the inner and outer sections of the discharge auger for operation as a single piece. However, a gap is provided in the flighting between ends 36*a* and 36*b* of the flighting of the two sections, and this gap involves the clearance for thermal contact member 55** which projects into the interior of the auger discharge tube.

Figure 4:
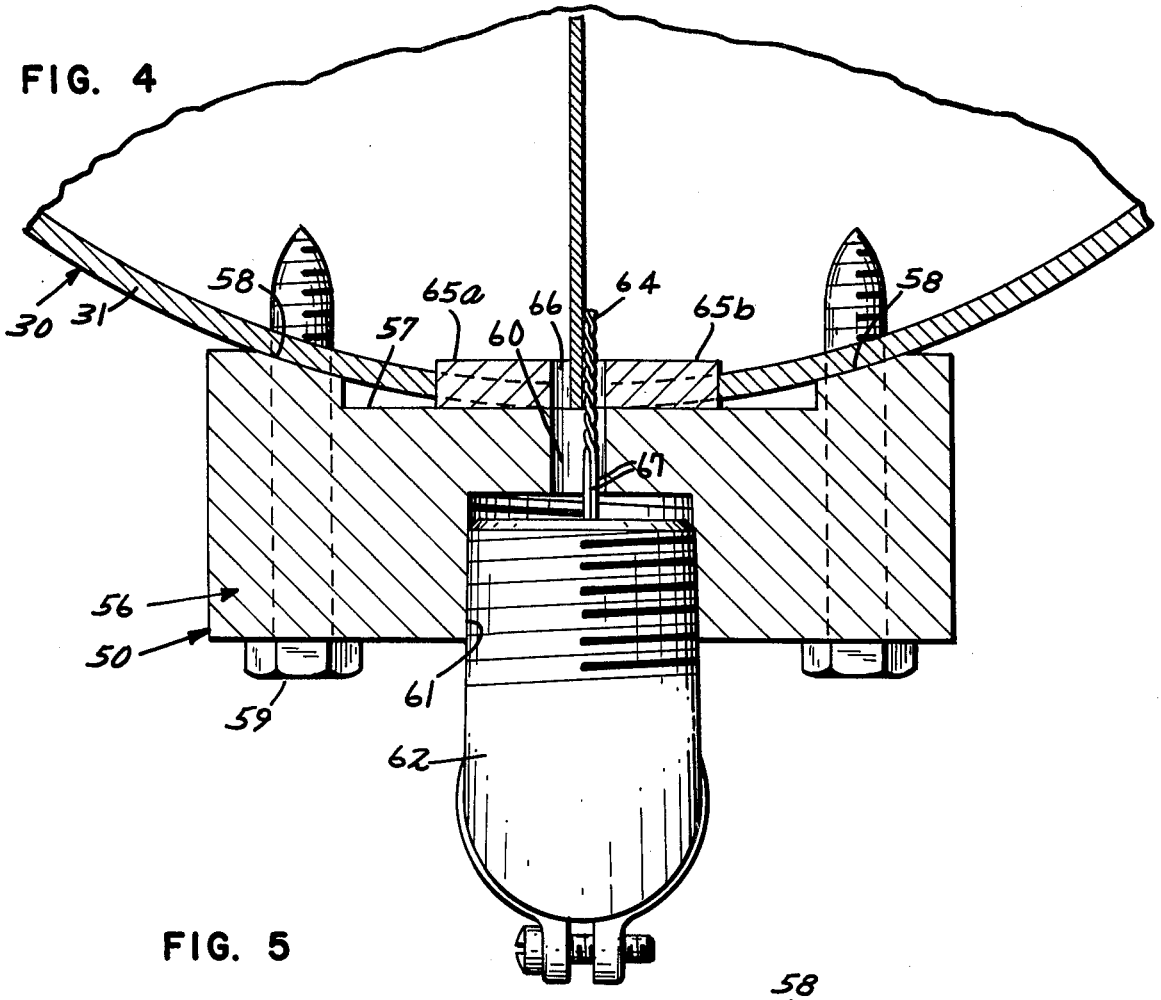
FIG. 4 is an enlarged fragmentary sectional view taken along line 4—4 of FIG. 3.
Figure 5:
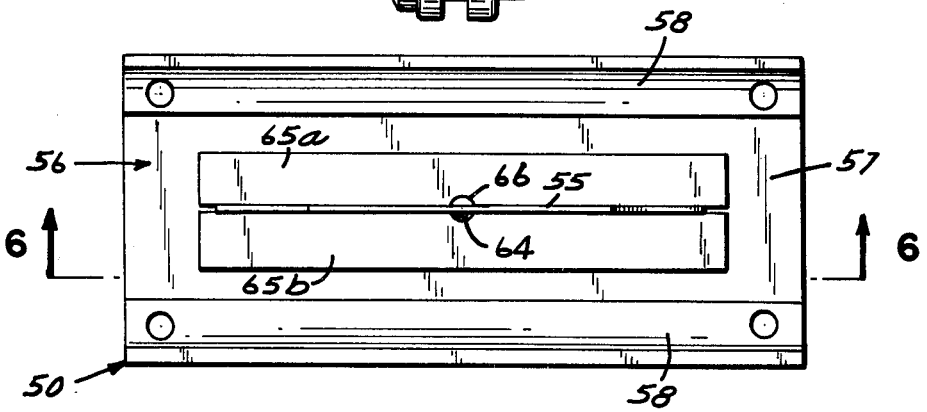
FIG. 5 is a top plan of the sensing assembly.
Figure 6:
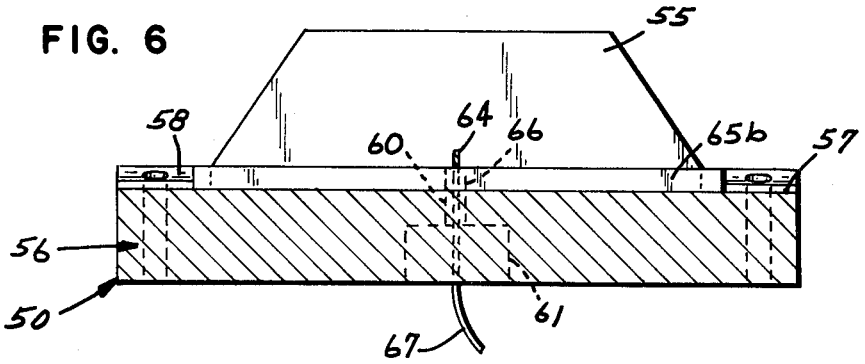
FIG. 6 is a vertical sectional view as seen from line 6—6 of FIG. 5.

The constructional details of sensor assembly 50 are better seen in FIGS. 4, 5 and 6. Reference number 56 generally designates an elongate body member. Member 56 has a channel formed in one surface thereof, which extends for the length of the body member. The channels is best seen in FIGS. 4 and 5, and is designated generally by reference number 57. On either side of channel portion 57, are a pair of arcuate portions 58 which are curved to fit against the outer wall of discharge tube 31, when the sensor is mounted in place as shown in FIG. 4. Body member 56 is secured to discharge auger tube 31 by means of a plurality of screws 59.

At the center of member 56, there is provided a small bore hole 60. This meets a large bore hole 61 which is provided in the other or bottom side of body member 56. Bore hole 61 is sized to receive one end of an elbow or L-shaped conduit 62 as seen in FIGS. 3 and 4. This conduit may be secured in member 56 by threads, by bonding, or by any other suitable means.

A pair of rectangular elongate supporting blocks 65*a* and 65*b* are bonded or otherwise secured to the channel portion 57 of the top side of body member 56. The thermal contact member 55 in the preferred embodiment comprises a vane which is positioned on edge along the middle of channel 57, and is bonded or otherwise secured to member 56 and supporting blocks 65*a* and 65*b*, which abut it on either side at the base thereof. Reference number 66 designates a bore 66 which is formed in supporting blocks 65*a* and 65*b* in alignment with bore hole 60 of member 56. Vane 55 is positioned directly across bore hole 60 and through bore hole 66 in the supporting blocks. The bore holes are sized somewhat larger than the thickness of vane 55, to provide a clearance for a thermocouple 64 and its leads 67.

As best seen in FIGS. 4 through 6, the thermocouple 64 is positioned up through bore holes 60 and 66, along one side of the base of vane 55. Thermocouple 64 is bonded to vane 55 by any suitable means, so as to maintain it in intimate thermal contact with the vane. Vane 55 is preferably made of copper or some other highly heat conductive material. In the preferred embodiment, vane 55 has a trapezoidal shape with the leading and trailing edges of the vane, as exposed to the flow of grain, tapered somewhat for minimum resistance and obstruction to flow.

Although the preferred embodiment shown in the drawings uses a flat, trapezoidal shaped vane, it will be appreciated that a wide variety of shapes could be used for the thermal contact member to which the thermocouple is attached. Other flat, rounded or non-planar shapes could be used, so long as enough surface area is presented in contact with the grain to provide adequate thermal contact in so long as the shape of the member does not unduly interfere with the flow of the grain.

As seen in FIG. 4, slot 53 is wide enough to receive supporting blocks 65*a* and 65*b*, when body member 56 is secured to the outside of discharge auger 31 by means of screws 59.

In operation, as the discharge auger is being operated, grain flows through the discharge auger tube 31 under the propelling force of the flighting 35. As the grain passes sensor assembly 50, a great number of individual kernels of the grain are brought into intimate thermal contact with vane 55 as they are slid or pushed along the sides thereof. The body of vane 55 then rapidly assumes the temperature of the passing grain, and since thermocouple 64 is in intimate thermal contact with the vane, the thermocouple output represents an accurate measure of the temperature of the grain at that point in the discharge tube.

The thermocouple is connected by means of lead wires 67, through L-shaped conduit 62 and conduit 51 to a control cabinet 52, where other elements of the control system can be housed.

Referring again to FIG. 2, the pre-dry sensor is generally indicated by reference number 70. Sensor 70 comprises a probe portion 71, and a wall mounting bracket 72 which is a channel sectioned member. A reinforcing member 73 may be provided to help support probe 71. Wall mounting bracket 72 is positioned on the inside of the bin so that probe 71 is approximately 12 inches above the apertured floor 13. Bracket 72 may be secured to the bin wall by means of bolts 79.

Figure 8:
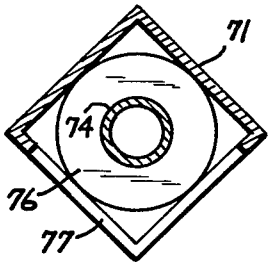
FIG. 8 is an enlarged sectional view taken generally along line 8—8 of FIG. 7.
Figure 7:
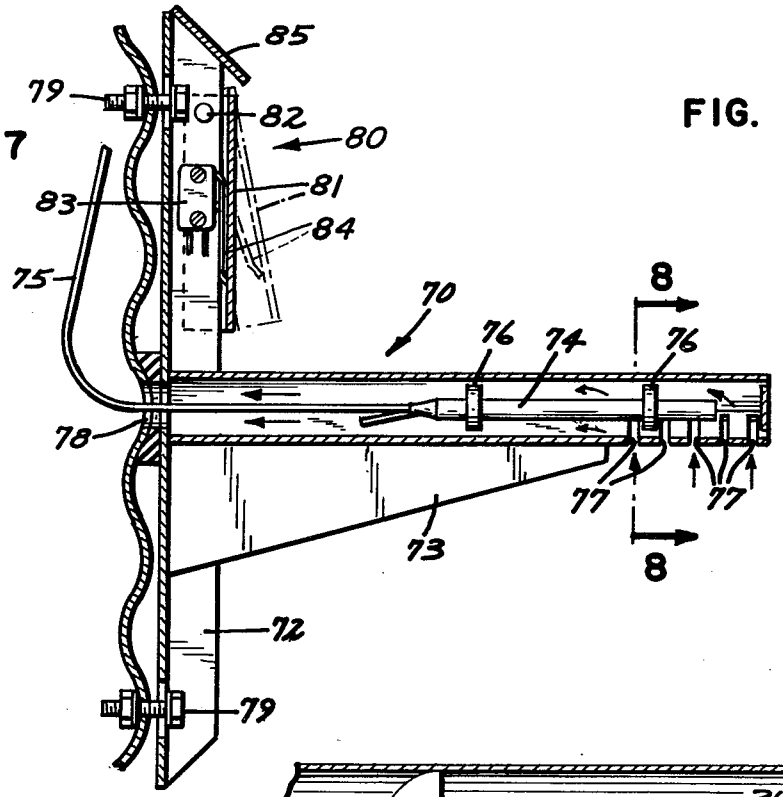
FIG. 7 is a view in cross section of the pre-dry sensor.

As seen in FIGS. 7 and 8, probe 71 in the preferred embodiment is a tubular member having a square cross section. The heat sensing element comprises a sensing bulb 74 which connects via a capillary tube 75 to a thermostatic control device (not shown) of conventional design. Sensing bulb 74 is positioned within probe 71 with the aid of washers 76. A plurality of slots 77 are provided on the underside of the outer end of probe 71 to allow heated air to enter the probe and come in thermal contact with sensing bulb 74. A clearance hole 78 is provided in the bin wall to allow capillary 75 to pass through the wall, and also to allow a small quantity of heated air to exit, thus insuring a small flow of air over the sensing bulb for good thermal response of the sensor.

In FIG. 7, reference number 80 generally designates the bin empty switch assembly. This assembly includes a plate 81 which is pivotally mounted at its top end to bracket 72 by means of a hinge pin 82. A switch 83 is attached to bracket 72 and positioned behind plate 81. Angled deflector plate 85 is secured across the top of bracket 72 to prevent grain from getting behind plate 81. Switch 83 has a spring loaded actuating lever 84 which is in contact with plate 81, pushing outwardly thereon. When the bin is full of grain up to the level of switch assembly 80, plate 81 is held against bracket 72 as indicated in solid lines in FIG. 7, which keeps switch 83 closed. When the bin level drops below assembly 80, plate 81 is free to move outwardly as indicated in broken lines in FIG. 7, and switch 83 opens.

As seen in FIG. 2, a thermostat probe 91 is provided for controlling the grain drying burners (not shown). Probe 91 is attached by means of a base portion 92 to the bin wall, with probe 91 projecting inside the bin in the heating air space beneath apertured floor 13. Probe 91 may contain a sensing bulb which connects by means of a capillary 93 to a conventional thermostatic control for the burner. For best results in the preferred embodiment, pre-dry sensor probe 71 and burner thermostat probe 91 should be mounted near each other, but not in direct vertical alignment. The preferred positioning is to have the two probes offset laterally approximately one foot from vertcial alignment with one another.

Figure 9:
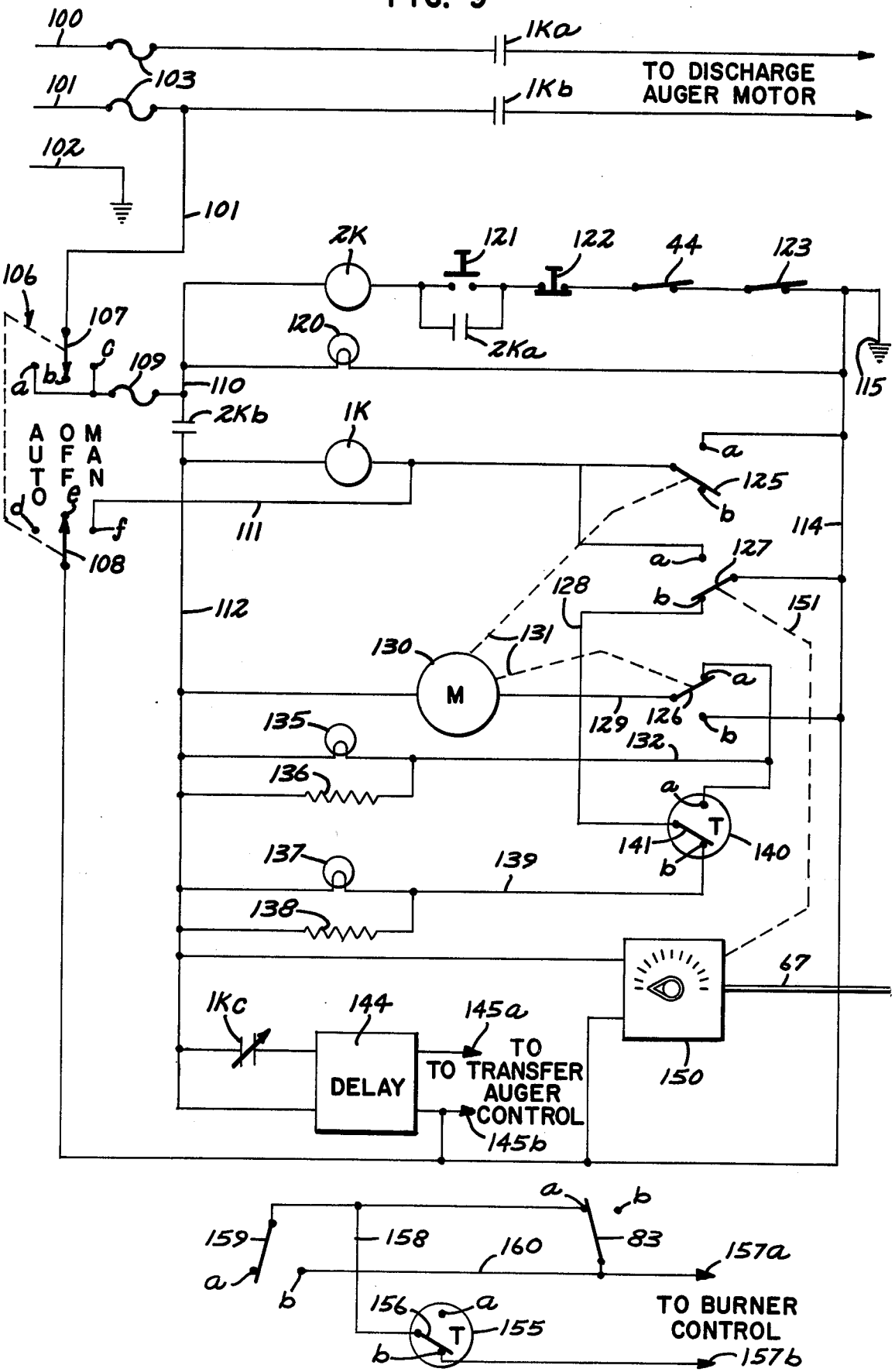
FIG. 9 is an electrical schematic diagram of the control system according to a preferred embodiment of the present invention.

The control circuit for the presently preferred form of the invention is shown in FIG. 9. Reference numbers 100 and 101 designate the line voltage leads in a single phase system, and reference number 102 represents the neutral, or grounded lead. Lines 100 and 101 connected to the rest of the system through a pair of line fuses indicated by reference number 103. Lines 100 and 101 connect through normally open relay contacts 1K*a* and 1K*b* to the motor for the discharge auger, not shown in FIG. 9.

A branch of lead 101 connects to a switch 106, which is used to turn the system to a manual mode, an automatic mode, or off. Switch 106 includes a pair of poles 107 and 108. Pole 107 may be switched among contacts a, b and c, while pole 108 may be switched among contacts d, e and f. Poles 107 and 108 are mechanically interconnected as indicated by the dotted line. Contacts a and c are connected together, and connect through a fuse 109 to a lead 110. Contact f connects to a lead 111. Contacts b, d and e are not connected.

Lead 110 connects to one side of a pair of relay contact 2K*b*. The other side of contacts 2K*b* connects to a lead 112. A lead 114 is connected to ground at reference number 115. A branch of lead 114 connects to pole 108 of switch 106.

An indicator lamp 120 is connected between leads 110 and 114. One side of relay coil 2K connects to lead 110. The other side connects through normally open push button switch 121, normally closed push button switch 122, switch 44 and switch 123 to lead 114 and ground. Relay contacts 2K*a* are connected in parallel around switch 121.

Relay coil 1K has one side connected to lead 112, and the other side connected to a branch of lead 111, which also connects to the pole of switch 125. A branch of lead 111 also connects to contact a of switch 127. Contact a of switch 125 connects to lead 114, and contact b is not connected.

The pole of switch 127 connects to lead 114, and contact b of that switch connects to a lead 128. Switch 126 has a pole connected to lead 129, and a contact a which connects to lead 132. Contact b of switch 126 connects to lead 114.

Motor 130 is connected to leads 129 and 112. Motor 130 and switches 125 and 126 are mechanically linked as indicated by broken lines 131. These elements comprise a motor driven cam switch assembly. A pair of cams are provided on a drive shaft from motor 130 which is geared to turn slowly as explained hereinafter. Switches 125 and 126 have followers which follow their respective cams so as to activate the switches at the appropriate times as explained hereinafter.

As indicator light 135 and a resistor 136 are connected between leads 132 and 112. Another indicator light 137 and resistor 138 are connected to lead 112, and their other sides are connected to a lead 139.

Reference number 140 designates the pre-dry thermostat, which is operated by the sensing bulb 74 in pre-dry sensor 70 shown in FIGS. 2 and 7. Thermostat 140 has a switch 141 having a pole connected to lead 128, a contact a connected to lead 132, and a contact b connected to lead 139.

A thermostatic control 150 is provided for discharge grain temperature sensor 50. Control 150 connects by leads 67 to thermocouple 64. Thermostatic control 150 also connects to leads 112 and 114. Control 150 has means for adjustably selecting a desired temperature, and it operates switch 127 as indicatd by broken lines 151.

A delay control 144 is connected to leads 112 and 114. It is also connected to lead 112 by a set of relay contact 1K*c*, which may be either normally open or normally closed, depending upon the electrical operating characteristics of the delay device. Delay device 144 has a pair of output terminals 145*a* and 145*b* which are connected to a suitable control relay for a transfer auger (not shown). Delay device 144 is designed so that when contact 1K*c* is activated, which occurs when the sweep and discharge auger motor is started, the transfer auger is also started. When contact 1K*c* switches back to its original state, delay device 144 maintains the transfer auger control operating for an additional short interval, so that the transfer auger can empty itself of grain. In the preferred embodiment, a 20 second delay is used, but other delays can be used depending upon the design of a particular system.

Reference number 155 designates a thermostat provided to control the burner for the grain drying bin. Thermostat 155 operates under control of thermostat probe 91 of FIG. 2. It includes a switch having a pole 156 and contacts a and b. Contact a is unconnected, and contact b connects to terminal 157*b*. Pole 156 connects to a lead 158, which in turn connects to the pole of a switch 159, and to terminal a of the bin empty switch 83. The pole of switch 83 connects to lead 160, which also connects to contact b of switch 159, and to terminal 157*a*.

In operation, the burner control operates for the most part independently of the rest of the control system. As long as there is sufficient grain in the bin to depress the bin empty switch plate 81, the burner is operated under control of thermostat 155 to deliver heated air to the space beneath the apertured floor 13, as is generally known in the grain drying art. When the grain level gets below about 1 foot, switch 83 opens, and the burner is disabled. Placing the bin empty switch at this position saves fuel, because it prevents the great escape of hot air and loss of efficiency that would occur if the drying process were allowed to proceed with only a thin layer of grain on the floor. This control also ensures that the augers will stop in the layer of dry grain maintained at the bottom of the bin, even when a new load of wet grain is filled from the top. This prevents the augers from becoming impacted and difficult to start rotating which sometimes occurs when augers are stopped for extended periods in wet grain. Switch 159 may be used to bypass the bin empty switch if desired.

With switch 106 in the off position the discharge auger cannot operate. In either the automatic position or the manual position of switch 106, power from lead 101 is applied to lead 110. Momentary depression of the switch 121 energizes relay coil 2K, which closes contacts 2K*a*, thus latching the relay. Contacts 2K*b* close, applying power to lead 112. Actuation of switch 106 also causes pilot light 120 to light.

If the manual position of switch 106 has been selected, power is applied to relay coil 1K from lead 112, through lead 111, switch contact f and lead 114 to ground. Actuation of relay coil 1K causes 1K*a* and 1K*b* to close, starting the discharge auger and sweep auger motor. At the same time, the transfer auger is energized as previously described.

If switch 106 is in the automatic position rather than the manual position, relay 1K can only be energized by switches 125 or 127.

For purposes of describing the operation of the control system, assume that a load of wet grain is in the bin, above the level of the bin empty switch. Assume the burner is operating, but the temperature in the grain has not yet reached the point to cause pre-dry thermostat 140 to switch. Pre-dry thermostat 140 is of course adjustable, so that a desired temperature can be preselected. In the preferred embodiment, a temperature of 30 degrees Fahrenheit less than the burner thermostat setting is recommended for the pre-dry sensor thermostat.

In the pre-dry mode switch 141 of thermostat 140 is at its b contact. Also, since cold grain is present in the discharge tube, the temperature at thermocouple 64 will be below the setting at thermostatic control 150, and switch 127 is at its b contact position. This provides a ground for indicator light 137 via switch 141 and lead 128. At this time switch 126 is in its a contact position, switch 125 is in its b contact position, motor 130 is off, relay 1K is unenergized, and the discharge auger motor is off.

When a preselected pre-dry temperature is reached at the pre-dry probe, switch 141 switches to its a contact, thus turning off indicator 137 and turning on indicator light 135 which indicates that the dry-sample cycle has begun. At the same time signal ground is applied to motor 130 via switch 127, lead 128, switch 141, lead 132, switch 126 and lead 129. Motor 130 then begins its timing cycle. A few minutes after the start of motor 130, the cam for switch 126 transfers it to contact b which continues to provide a ground for operating motor 130.

At the end of 33 minutes of drying time, switch 125 is transferred to the a position by its cam. The cam is designed so that switch 125 will remain in the a position for approximately 3 minutes, which is the time required to insure that a representative sample of the dried grain is brought out the discharge tube to the thermocouple sensor. When switch 125 transfers to the a contact, relay 1K is energized and the discharge auger begins.

If the grain is not yet dried sufficiently, switch 127 will not transfer, and relay 1K and the discharge motor will be stopped at the end of the 3 minute sample period when switch 125 switches back to the b contact. Motor 130 will continue to run, even as switch 126 transfers back to contact a at the home position for the cam switch assembly, because ground is still maintained through contact b of switch 127. The 33 minute drying period is then repeated, and another 3 minute sample is taken.

If during the 3 minute sample period the grain has reach sufficient temperature to indicate the desired low moisture content, thermostat control 150 will cause switch 127 to transfer to the a contact, thus holding relay 1K in the on position and maintaining the discharge and transfer augers in operation. Motor 130 then continues to run but only until the end of the sample period, when the cam for switch 126 causes it to transfer back to the a position. Since no ground is available through contact b of switch 127, the motor stops at its home position, in readiness for the next dry-sample cycle.

Meanwhile, grain continues to be drawn off the bottom of the bin by the sweep augers and is sent out the discharge tube past the temperature sensor therein. As long as warm, dry grain continues to be withdrawn, the augers remain in operation. As soon as cold, moist grain reaches the temperature sensor 50 in the discharge tube, contact 127 switches back to the b contact, thus deenergizing relay 1K and stopping the discharge auger motor. Twenty seconds later the transfer auger control is stopped. When switch 127 transfers to the b contact, the system reverts either to the pre-dry mode or the dry-sample mode, depending upon how cool the grain is at the pre-dry sensing probe 70. If the grain is too cold, the dry-sample mode is delayed until pre-dry thermostat 140 switches again to the a contact. Eventually all grain is dried and transferred out of the bin until the 1 foot level is reached and the burner is shut off as explained above.

The system may be stopped at any time by pushing normally closed push button 122, which breaks the circuit to relay 2K, thus disconnecting the system. The system can also be stopped by opening either switch 44 or switch 123. Switch 44 as previously explained is associated with the position of cover 42 for the discharge tube. Switch 44, which is a mercury switch, opens when the cover is tilted from approximately 45 degrees toward horizontal, indicating a fault in the transfer augers and a build-up of a pile of grain beneath cover 42. Contact 123 may be associated with a bin full sensor for an auxiliary bin to which the dried grain is being transferred. When that bin is full switch 123 would be opened.

The present invention provides an improved grain dryer control system with an improved temperature sensor at the discharge tube attached to a grain thermal contact body, and having a pre-dry sensor within the bin. The system delays the start of the dry-sample mode until the grain has been sufficiently pre-dried to avoid unloading large amounts of wet grain in a number of sample cycles. After pre-drying has been achieved, the system controls the drying and unloading of dried grain by the improved grain temperature sensor at the discharge tube.

I claim:

1. A control system for a grain drying system of the type which includes a drying bin, means for circulating drying air therethrough, and a discharge auger for removing dried grain from the bin, comprising:

a pre-dry temperature sensing means positioned in said bin for submersion by grain a short distance above the level of removal thereof by the discharge auger, for sensing the temperature of grain in the bin;

discharge grain temperature sensing means positioning in the discharge auger for sensing the temperature of grain in the discharge auger;

first control means connected to said discharge grain temperature sensing means and said discharge auger for periodically starting the discharge auger to remove grain from the bin and for stopping the auger if the discharge grain temperature sensing means indicates that the grain is below a predetermined temperature; and second control means connected to said pre-dry temperature sensing means and said first control means for delaying operation of said first control means and said discharge auger until the pre-dry sensing means has reached a predetermined temperature.

2. A control system for a grain drying system of the type which includes a drying bin having an apertured drying floor through which drying air is circulated and a discharge auger for removing dried grain from the bin, comprising:

pre-dry temperature sensing means positioned in said bin for submersion by grain a short distance above said drying floor, for sensing the temperature of grain in the bin;

discharge grain temperature sensing means positioning in the discharge auger for sensing the temperature of grain in the discharge auger;

first control means connected to said discharge grain temperature sensing means and said discharge auger for periodically starting the discharge auger to remove grain from the bin and for stopping the auger if the discharge grain temperature sensing means indicates that the grain is below a predetermined temperature; and second control means connected to said pre-dry temperature sensing means and said first control means for delaying operation of said first control means and said discharge auger until the pre-dry sensing means has reached a predetermined temperature.

3. A control system for a grain drying system according to claim 2 wherein said pre-dry temperature sensing means includes a probe mounted on the bin wall projecting inwardly to the bin approximately 1 foot above the drying floor.

4. A control system for a grain drying system according to claim 1 wherein said discharge grain temperature sensing means includes a thermal contact member projecting inwardly of a tube housing the discharge auger for contact with grain moving within the auger, and a temperature sensing element attached to said thermal contact member in intimate thermal contact therewith.

5. A control system for a grain drying system according to claim 1 wherein said first and second control means include thermostatic controls connected to said discharge grain temperature sensing means and said pre-dry temperature sensing means, respectively.

6. A control system for a grain drying system according to claim 1 further including a door pivotally suspended at the outlet end of the discharge auger tube, said door hanging vertically closed when no grain is being discharged and being pushed outwardly when grain is being discharged, and position sensitive switching means attached to said door and conneced to said first control means, for stopping said discharge auger when said door is pushed outwardly more than a predetermined amount, to stop the auger in the case of undue accumulation of grain beneath said outlet end of the discharge auger tube.

7. A control system according to claim 1 wherein said discharge grain temperature sensing means comprises a thermal contact member, a temperature sensing element, means for mounting said temperature sensing element to said thermal contact member in heat conducting relationship thereto, and means for mounting said thermal contact member to the discharge auger tube projecting inwardly into the grain path within the auger.

8. A control system according to claim 7 wherein said thermal contact member comprises a planar vane, wherein said means for mounting includes a body member having a pair of supporting blocks with said vane positioned on edge between said supporting blocks, and wherein said discharge auger tube has a slot sized to accept said vane, said body member being secured to the outside of said discharge auger tube with said vane projecting through said slot into the grain-carrying area of the discharge auger, in alignment with the axis of the auger.

9. A control system according to claim 8 wherein said vane extends a substantial distance into said discharge auger tube and wherein a gap is provided in the flighting of the discharge auger for clearance for said vane.

10. A control system according to claim 8 wherein said temperature sensing element comprises a thermocouple bonded to said vane.

11. A control system for a grain drying system according to claim 2 wherein said discharge grain temperature sensing means includes a thermal contact member projecting inwardly of a tube housing the discharge auger for contact with grain moving within the auger, and a temperature sensing element attached to said thermal contact member in intimate thermal contact therewith.

12. A control system for a grain drying system according to claim 2 wherein said first and second control means include thermostatic controls connected to said discharge grain temperature sensing means and said pre-dry temperature sensing means, respectively.

13. A control system for a grain drying system according to claim 2 further including a door pivotally suspended at the outlet end of the discharge auger tube, said door hanging vertically closed when no grain is being discharged and being pushed outwardly when grain is being discharged, and position sensitive switching means attached to said door and connected to said first control means, for stopping said discharge auger when said door is pushed outwardly more than a predetermined amount, to stop the auger in the case of undue accummulation of grain beneath said outlet end of the discharge auger tube.

14. A control system according to claim 2 wherein said discharge grain temperature sensing means comprises a thermal contact member, a temperature sensing element, means for mounting said temperature sensing element to said thermal contact member in heat conducting relationship thereto, and means for mounting said thermal contact member to the discharge auger tube projecting inwardly into the grain path within the auger.

15. A control system according to claim 14 wherein said thermal contact member comprises a planar vane, wherein said means for mounting includes a body member having a pair of supporting blocks with said vane positioned on edge between said supporting blocks, and wherein said discharge auger tube has a slot sized to accept said vane, said body member being secured to the outside of said discharge auger tube with said vane projecting through said slot into the grain-carrying area of the discharge auger, in alignment with the axis of the auger.

16. A control system according to claim 15 wherein said vane extends a substantial distance into said discharge auger tube and wherein a gap is provided in the fighting of the discharge for clearance for said vane.

17. A control system according to claim 15 wherein said temperature sensing element comprises a thermocouple bonded to said vane.

* * * * *

UNITED STATES PATENT AND TRADEMARK OFFICE

CERTIFICATE OF CORRECTION

PATENT NO. : 4,152,840

DATED : May 8, 1979

INVENTOR(S) : Larry L. Stille

It is certified that error appears in the above-identified patent and that said Letters Patent are hereby corrected as shown below:

In the Abstract, line 13, "fighting" should be--flighting--

Column 1, line 2, "gain" should be --grain--

Column 2, line 22, "thermocoupled" should be --thermocouple--

Column 3, line 37, "kennels" should be --kernels--

Column 4, line 63, "channels" should be --channel--

Column 6, line 53, "connected" should be --connect--

Column 6, line 59, "conncts" should be --connects--

Column 7, line 2, "contact" should be --contacts--

Column 7, line 52, "contact" should be --contacts--

Column 9, line 1, "a" should be --the--

Column 10, line 21, "a" should be deleted (Claim 1)

Column 11, line 21, " conneced" should be --connected-- (Claim 6)

Column 12, line 24, "accummulation" should be --accumulation-- (Claim 13)

Column 12, line 49, "fighting" should be --flighting-- (Claim 16)

Signed and Sealed this

*Twenty-eighth* Day of *August 1979*

[SEAL]

*Attest:*

*Attesting Officer*

LUTRELLE F. PARKER

*Acting Commissioner of Patents and Trademarks*